United States Patent [19]

Breuer

[11] Patent Number: 4,924,748

[45] Date of Patent: May 15, 1990

[54] HAND-OPERATED LEVER FOR OPENING AND CLOSING A WEDGE-LIKE BREECHBLOCK

[75] Inventor: Heinz G. Breuer, Duisburg, Fed. Rep. of Germany

[73] Assignee: Rheinmetall GmbH, Düsseldorf, Fed. Rep. of Germany

[21] Appl. No.: 364,092

[22] Filed: Jun. 9, 1989

[30] Foreign Application Priority Data

Jul. 4, 1988 [DE] Fed. Rep. of Germany ..... 3822556

[51] Int. Cl.[5] ..... F41F 11/02

[52] U.S. Cl. ..... 89/24; 89/198; 42/14

[58] Field of Search ..... 89/24, 198; 42/14, 23

[56] References Cited

U.S. PATENT DOCUMENTS

| | | | |
|---|---|---|---|
| 798,882 | 9/1905 | Dearborn . | |
| 2,434,970 | 1/1948 | Summerbell . | |
| 2,434,972 | 1/1948 | Vick . | |
| 2,522,497 | 9/1950 | Beardsley et al. . | |
| 4,569,269 | 2/1986 | Breuer | 89/24 |

FOREIGN PATENT DOCUMENTS

| | | | |
|---|---|---|---|
| 552176 | 1/1958 | Canada | 89/24 |
| 495227 | 4/1930 | Fed. Rep. of Germany | 89/24 |
| 261872 | 12/1926 | United Kingdom | 89/24 |

*Primary Examiner*—Charles T. Jordan
*Assistant Examiner*—Stephen Johnson
*Attorney, Agent, or Firm*—Spencer & Frank

[57] ABSTRACT

A hand-operated opening lever in a gun is pivotal about an opener shaft to move a wedge-type breechblock between an open position and a closed position, and includes: a lever body which is movable between a first, rest position and a second position for respective manual opening and closing operations; the lever body including a manually displaceable locking bolt and an energy storing device which includes a receiving chamber; a transfer device in form-locking connection with the opener shaft for transferring stored energy between the opener shaft and the lever body for actuating the opener shaft to move the wedge-type breechblock between the open position and the closed position; the transfer device, during automatic opening of the breechblock, causing energy to be stored in the energy storing device in the lever body, and transferring stored energy from the energy storing device to the breechblock during automatic closing of the breechblock; the transfer device including a follower member selectively engaged with the lever body during the manual opening and closing operations; the energy storing device including a gas pressure spring; the energy storing device being compressed by the transfer device during automatic opening of the wedge-type breechblock and, during the movement of the breechblock to the closed position, the energy storing device drives the toothed rod to cause the breechblock to move to the closed position; the energy storing device being inoperable during manual opening and closing of the wedge-type breechblock by the lever body.

10 Claims, 3 Drawing Sheets

HAND-OPERATED LEVER FOR OPENING AND CLOSING A WEDGE-LIKE BREECHBLOCK

CROSS-REFERENCE TO RELATED APPLICATION

The present disclosure relates to the subject matter disclosed in German Application No. P 38 22 556.5 of July 4th, 1988, the entire specification of which is incorporated herein by reference.

BACKGROUND OF THE INVENTION

The present invention relates to a hand-operated lever for opening and closing a wedge-type breechblock wherein the opening lever is pivotal about an opener shaft and includes an energy storing element, the operating lever including a transfer apparatus for causing closing movement of the breechblock, the energy storing element when in a rest position of the operating lever being compressed by the transfer apparatus which is in form-locking connection with the opener shaft during the automatic opening of the breechblock, and wherein the energy storing element remains out of operation during manual opening and closing of the breechblock by use of the opening lever.

Such a hand-operated opening lever is disclosed in DE-OS 3,212,522, which corresponds to U.S. Pat. No. 4,569,269. This hand-operated opening lever causes the opener shaft to open and close a wedge-type breechblock that is part of a gun, so as to easily perform a manual opening and closing movement over a small angle of rotation without having to overcome a spring force. After return of the hand-operated opening lever into its rest position, the wedge-type breechblock is automatically caused to be in a blocked position which is secured against movement. This hand-operated opening lever, when in its rest position, permits the automatic performance of the sequence of movements required for operation of the wedge-type breechblock.

In this prior art hand-operated opening lever, a coil spring is used to store the energy which must be expended during the closing process. However, such coil springs have a very steep spring constant or characteristic curve (of force as a function of distance), so that the force required for the closing movement of the wedge-type breechblock is not available at the same high level over an entire closing stroke. Essentially, this steep spring constant or characteristic curve is determined by the limited space available for the opening lever, for example by the space available in the close quarters of the turret of a combat tank, and a proper closing operation of the breechblock is, under certain circumstances, ensured only for relatively light-weight breechblocks, for example for guns having a caliber up to about 105 mm. In contrast thereto, with a larger caliber gun, the weight of the breechblocks increases considerably so that, due to the increased required level of energy expenditure for the closing movement of the wedge-type breechblock in such a larger caliber gun, the space which would be required for the above-described compression spring would not be available in the close quarters of the turret of a combat tank.

Another drawback in the aforementioned prior art hand-operated opening lever is that the exchange of a single compression spring, or for the exchange of a complete hand lever component group, involves considerably high costs, and furthermore, the exchange of the compression spring or the component group is time consuming.

SUMMARY OF THE INVENTION

It is therefore an object of the present invention to provide a hand-operated opening lever for opening and closing the breechblock of a gun, with which it is possible to reliably manually perform opening and closing operations for the breechblock, particularly for relatively heavy breechblocks of larger caliber guns, with the gun operating automatically within confined areas, and preferably for use in a tank turret. Another object is to permit relatively simple and rapid exchange of essential parts in th opening lever that are subject to wear.

This is accomplished by the provision of a hand-operated opening lever in a gun which is pivotal about an opener shaft for actuating the opener shaft to move a wedge-type breechblock between an open position and a closed position, and includes:

a lever body pivotally connected to a support for movement relative to the opener shaft, the lever body being movable between a first, rest position and a second position for respective manual opening and closing operations; the lever body including a manually displaceable locking bolt and an energy storing device which includes a receiving chamber;

a transfer device in form-locking connection with the opener shaft for transferring stored energy between the opener shaft and the lever body for actuating the opener shaft to move the wedge-type breechblock between the open position and the closed position; the transfer device, during automatic opening of the breechblock, causing energy to be stored in the energy storing device in the lever body, and transferring stored energy from the energy storing device to the breechblock during automatic closing of the breechblock; the transfer device including a follower member which is selectively engaged with the lever body during the manual opening and closing operations; the follower member including a form-locking connection with the lever body during the manual opening operation of the wedge-type breechblock, and, during the manual closing process, including a form-locking connection with the manually displaceable locking bolt mounted in the lever body;

the energy storing device comprising a gas pressure spring having a piston and a toothed rod connected to the piston, the gas pressure spring being disposed in the receiving chamber within the lever body; the toothed rod being in engagement, with the transfer device; the energy storing device, in the first, rest position of the hand-operated opening lever, being compressed by the transfer device during automatic opening of the wedge-type breechblock and, during the movement of the breechblock to the closed position, the energy storing device drives the toothed rod to cause the breechblock to move to the closed position; the energy storing device being inoperable during manual opening and closing of the wedge-type breechblock by the lever body.

The invention advantageously includes a space saving gas compression spring which has a comparatively flat spring characteristic curve and which is integrated with a hand-operated opening lever, instead of an energy storing apparatus in the form of a wound compression spring having a relatively steep spring characteristic curve. The flat spring characteristic curve of the gas compression spring ensures realization of a relatively uniform closing stroke for the wedge-type breechblock by transfer thereto of an approximately constant force.

The spring force required varies in each case due to differing weights of breechblocks. This required spring force can be generated in a particularly simple manner by a change in the pressure level of the gas compression spring. In this way it is possible to keep the external geometric dimensions of the hand-operated opening lever essentially constant for a variety of breechblock weights and to use the hand-operated opening lever even in close quarters, for example in a tank turret, for the automatic and manual closing of the wedge-type breechblock, particularly in large-caliber guns.

According to another feature of the invention, the transfer of the rotary movement of the opener shaft from a transfer apparatus connected therewith is by way of a toothed rod connected to actuate the gas compression spring. This apparatus permits an arrangement of these components relative to one another in a compact housing which permits relatively fast and easy exchange of, for example, a damaged gas compression spring without removal of any other components.

A hand-operated locking lever is mounted in the hand-operated opening lever according to the invention to establish a form-locking connection between the hand-operated opening lever and the transfer apparatus. The hand-operated locking lever can be actuated to permit use of the hand-operated opening lever for closing a difficult-to-move breechblock, thereby permitting continuation of the closing process manually while necessitating use of only one hand of the operator.

The transfer apparatus according to the invention is configured for operation through an angular range $\alpha$ corresponding to the rotation required in order to complete a compression stroke of the gas compression spring. This configuration of the transfer apparatus permits reliable translation of the rotational movement of the transfer apparatus into a reciprocatory movement of the toothed rod which drives the gas compression spring, and also permits the space saving arrangement for establishing respective form-locking connections between the hand-operated locking lever and the transfer apparatus for manually moving the breechblock to its open and its closed positions.

Additionally, a locking member is connected with the hand-operated opening lever and has a portion which permits engagement with a fastening device connected to the base member to permit the operator to quickly place the hand-operated opening lever in its first, rest position.

Advantageously, the transfer apparatus is connected to an outer end of the opener shaft by inwardly toothed bushings forming a splined connection, and the hand-operated opening lever is connected in a form-locking manner with the transfer apparatus, thereby making it possible to easily and completely release the hand-operated opening lever from the opener shaft by release of a connecting member which retains together the hand-operated opening lever, the transfer apparatus, and the opener shaft.

The invention will now be described in greater detail with reference to an embodiment that is illustrated in the drawings.

DETAILED DESCRIPTION OF THE PREFERRED EMBODIMENT

Figure 1:
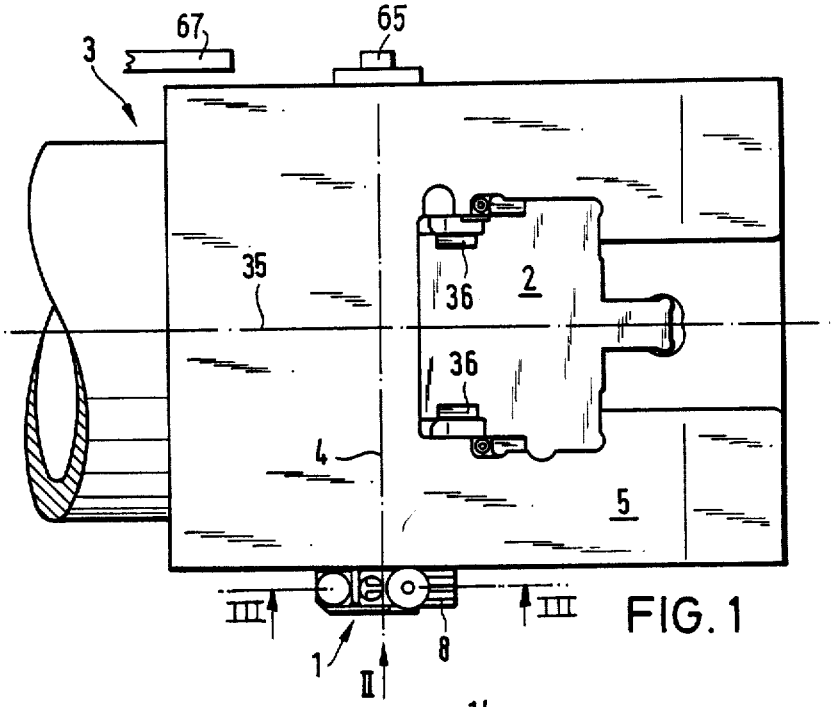
FIG. 1 is a top elevational view of a gun barrel base member including a wedge-type breechblock and a hand-operated opening lever.
Figure 2:
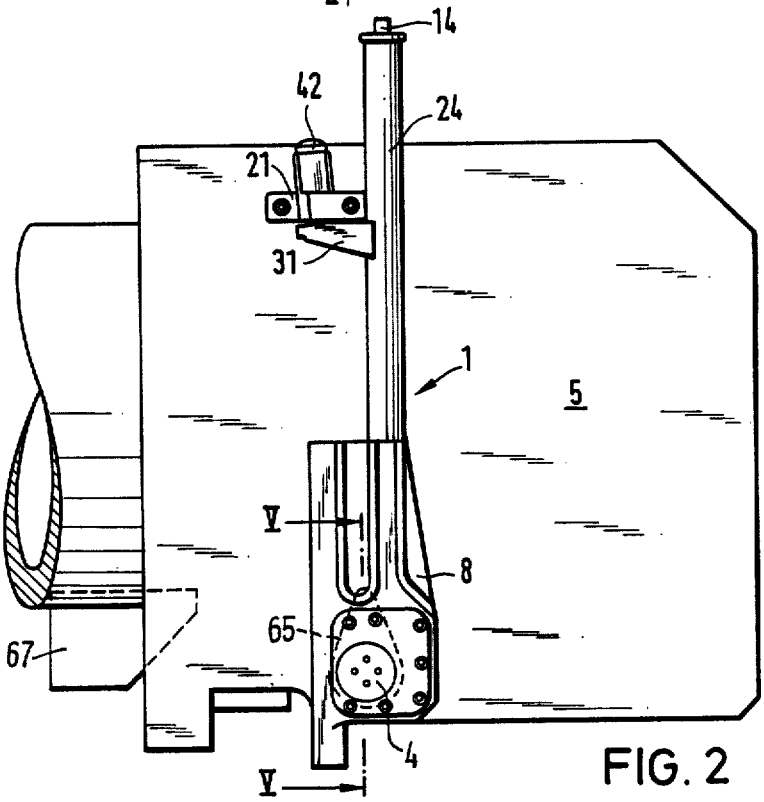
FIG. 2 is a front elevational view of the hand-operated opening lever and a base member taken along a direction indicated as II in FIG. 1.
Figure 5:
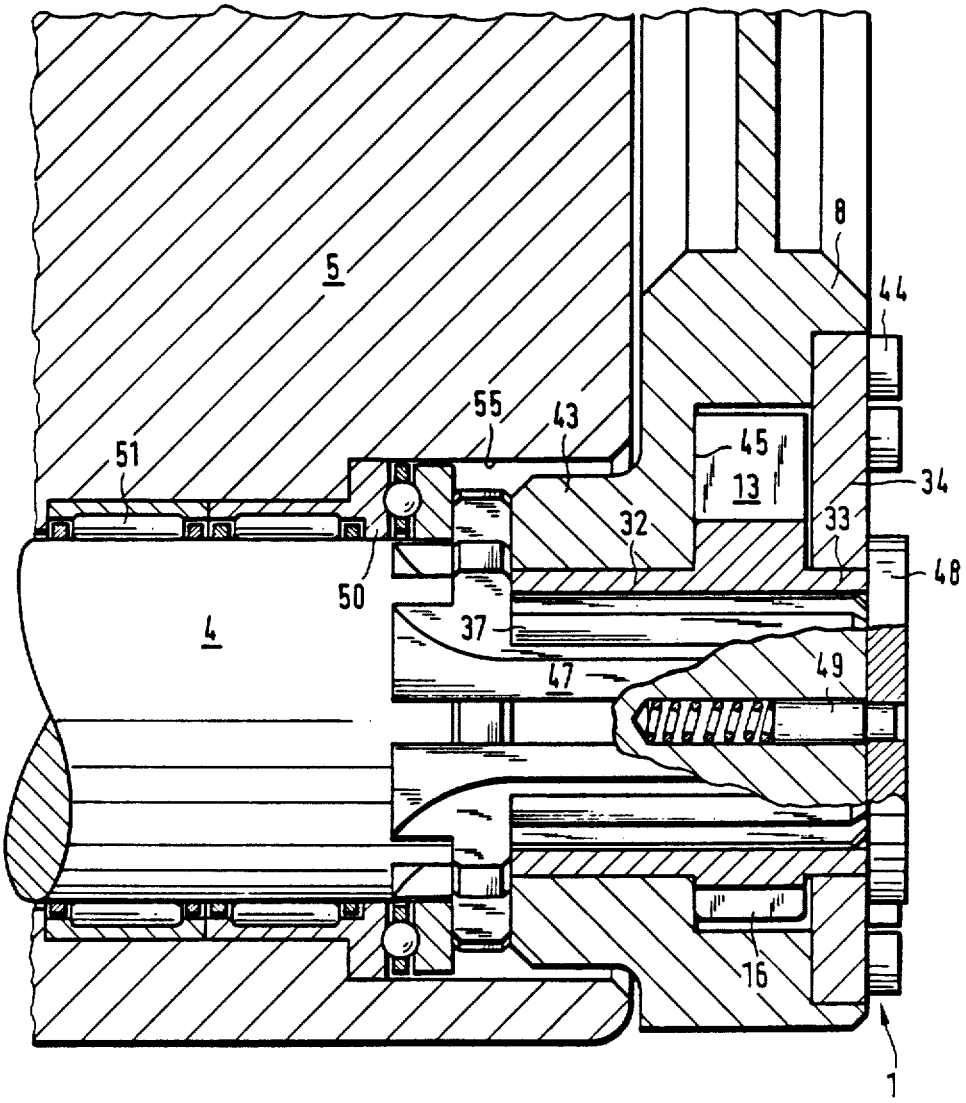
FIG. 5 is an enlarged sectional view of the connection of the hand-operated opening lever with an opener shaft disposed in the base member as taken along line V—V in FIG. 2.

FIGS. 1 and 2 show a rear end of a gun 3, including a base member 5 and a wedge-type breechblock 2. The breechblock 2 is displaceable in a direction which is essentially transverse to a bore axis 35 of the barrel of the gun 3 by actuation of two opening levers 36 and 36'. The arrangement and operation of the opening levers 36 and 36', which are driven by an opener shaft 4 which is shown in an enlarged view in FIG. 5, is known and is disclosed in DE-OS 3,212,522, which corresponds to U.S. Pat. No. 4,569,269, and therefore the opening levers 36 and 36' are not further illustrated.

Figure 3:
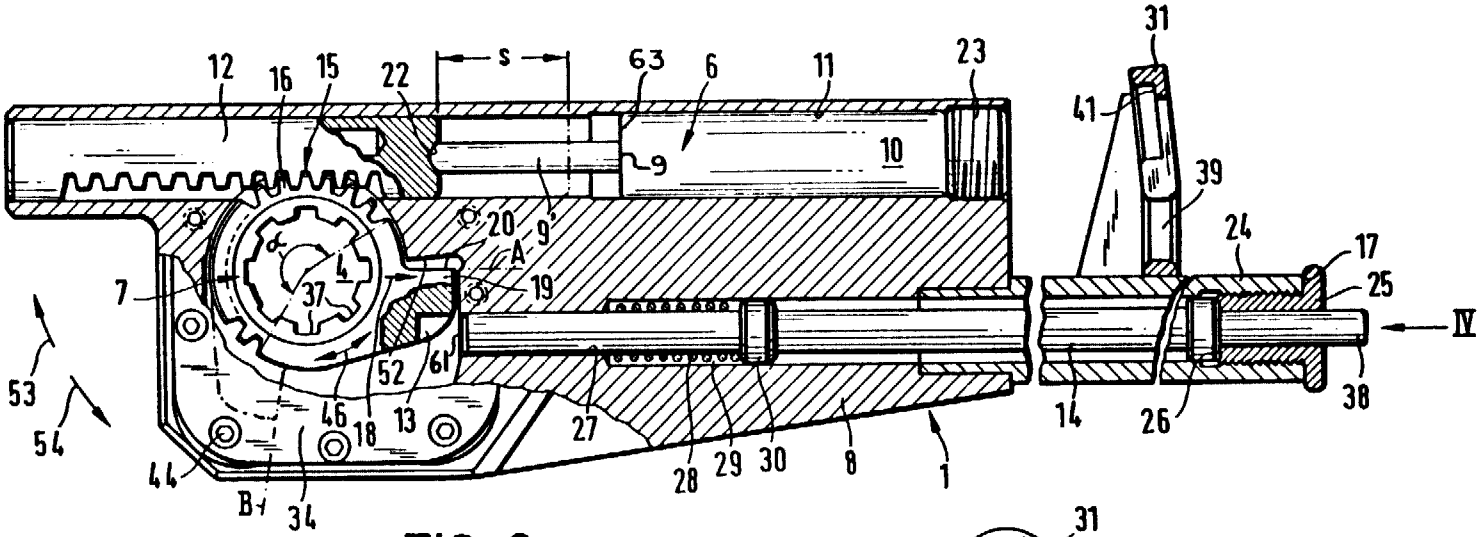
FIG. 3 is a longitudinal sectional view of the hand-operated opening lever taken along line III—III of FIG. 1.
Figure 4:
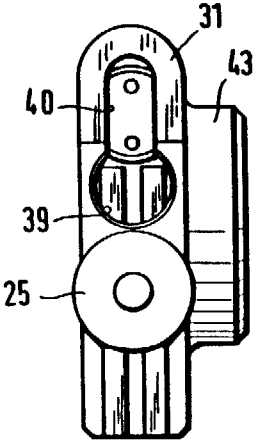
FIG. 4 is a top elevational view of the hand-operated opening lever along a direction indicated as IV in FIG. 3.

In a lateral, outer region of the base member 5, a hand-operated opening lever 1 is connected in a form-locking manner to a transfer apparatus or means 7, which in turn is connected by a splined connection 37 to an opener shaft 4 as shown in FIG. 5. FIGS. 1, 2 and 4 show the outer contours of the hand-operated opening lever 1 and show a forged or cast housing or lever body 8. The lever body 8 is preferably composed of steel and is designed to accommodate internal components which are shown in detail in FIGS. 3 and 5. A guide 24 is shown in FIG. 3 and receives a locking bolt 14 which can be operated by thumb pressure. The guide 24 is connected to the lever body 8. The locking bolt 14 is actuated to cause engagement of the lever body 8 with the opener shaft 4 to cause manual closing of the wedge-type breechblock 2, as discussed further hereunder. A locking member 31 is disposed on an exterior portion 15 of the guide 24. The locking member 31 automatically engages with a fastening device 21 disposed at the base member 5 in a first, rest position of the hand-operated opening lever 1.

In FIGS. 1 and 2, an activating lever 65 and a cooperating buffer cam 67 are schematically shown, which are known in the prior art from U.S. Pat. No. 2,756,635, and which together constitute an opening and closing means for opening and closing the breechblock 2.

As shown in FIGS. 3 and 5, the lever body 8 is pivotally connected by the transfer apparatus 7 to the opener shaft 4. At the exterior portion 15, over an angular range $\alpha$, the transfer apparatus 7 includes a portion which is shaped as a wheel 16. The wheel 16 has a toothed portion which engages a toothed rod 12 that can reciprocate within a portion of the lever body 8.

The lever body 8 has a receiving chamber 11 having a cylindrical opening 10 disposed along the direction of displacement of the toothed rod 12 and beyond the excursion of the toothed rod 12 in the receiving chamber 11. A threaded insert member 23 is threadedly engaged with a portion of the receiving chamber 11 and is disposed in a distal portion of the cylindrical opening 10, and plugs a distal end of the receiving chamber 11.

A piston 9 is connected to the toothed rod 12, forming an energy storing element in the form of a gas compression spring 6 in which gas is compressed between the piston 9 and the portion of the receiving chamber 11 extending from the piston 9 to the threaded insert member 23. The piston 9 has a piston head 63 and a piston rod 9' which is connected to the toothed rod 12. One end of the piston rod 9' of the gas compression spring 6 is supported in a centering portion 22 of the toothed rod 12. The other end of the piston rod 9' enters the cylindrical opening 10 when the toothed rod 12 is displaced longitudinally by a compression stroke having a length indicated as s in FIG. 3. This causes compression of the gas present in the cylindrical opening 10, this gas preferably being composed of nitrogen. Such gas compression springs 6 are commercially available, and therefore no further description or illustration of this gas compression spring is necessary.

As discussed hereinabove, a distal end of the receiving chamber 11 of the gas compression spring 6 is closed off by the threaded insert member 23 in the lever body 8 at the distal end of the receiving chamber 11. By releasing or replacing the insert member 23, it is relatively easy to adjust or modify the gas compression spring 6.

The toothed wheel 16 has a plurality of teeth which are disposed along a circumferential path along the angular range $\alpha$ of the toothed wheel 16. This circumferential path has a length which is slightly larger than the displacement length indicated by s in FIG. 3 of the toothed rod 12 during the compression stroke of the gas compression spring 6. Preferably, the angular range $\alpha$ of the toothed wheel 16 is in a range of 120° to 180°.

The transfer apparatus 7 includes the toothed wheel 16, the splined connection 37, and a projection 19 having on one side thereof a recess 13 and on the other side thereof a follower surface 20. The lever body 8 has a face 52 which is positioned for engagement with the follower surface 20 during a manual opening process for moving the breechblock 2 to an open position. During this manual opening process, the projection 19 forms a form-locking connection with the face 52 of the lever body 8. The projection 19 forms, together with the surface 20 and the recess 13, a means for engaging the hand-operated opening lever. During a closing process for moving the breechblock 2 to a closed position, the locking bolt 14 is manually urged axially toward the toothed wheel 16 and into the recess 13, so that the recess 13 forms a form-locking connection with a distal end 61 of the manually displaceable locking bolt 14. To accomplish this, the recess 13 and the follower surface 20 of the projection 19 are disposed at a portion of the toothed wheel 16 of the transfer apparatus 7 which is outside of the angular range $\alpha$ of the toothed portion of the toothed wheel 16.

The guide 24 has a portion which is received within the lever body 8 and another portion which projects from the lever body 8. The guide 24 is preferably welded to the lever body 8. The guide 24 has a proximal end having an outer frontal face 17 and has a threaded bore which receives a threaded insert member 25. The threaded insert member 25 has an end face 26 for limiting travel of the locking bolt 14, by serving as a stop member.

Within the lever body 8, the locking bolt 14 is supported in a housing bore 27 which has a widened section 29 to accommodate a return spring 28. The locking bolt 14 has an enlarged annular portion 30 which engages and supports one end of the return spring 28 in order to return the locking bolt 14 to a position in which it is released from the recess which forms the recess 13 of the transfer apparatus 7.

In the released position, a proximal free end 38 of the locking bolt 14 projects through the screw insert 25, so that the frontal face of the proximal free end 38 of the locking bolt 14 can be operated manually. Therefore, thumb pressure can be applied against the proximal free end 38 to axially urge the locking bolt 14 into the guide 24. The guide 24 has a portion adjacent the end face 17 which has the shape of a handle, to facilitate manual operation.

The locking member 31 is releasably fastened to the exterior portion 15 of the guide 24 such that it can engage the fastening device 21 disposed on the base member 5. As shown in FIG. 4, the locking member 31 has a circular opening 39 in communication with a slot 40. The slot 40 is narrower in width than the diameter of the circular opening 39. On the side of the slot 40 facing toward the lever body 8, the slot 40 has a blind bore 41. In order to take up the rest position of the hand-operated opening lever, a fastening means 21 as shown in FIG. 2 disposed on the base member 5 engages in the blind bore 41. The fastening device 21 includes a pin 42 which can be displaced against the force of a spring (not shown). The pin 42 has a head which initially extends downwardly through the circular opening 39. The pin 42 has a web (not shown) connected to the head (not shown), the web passing within the slot 40 during movement of the head of the pin 42 toward the blind bore 41. During movement of the opening lever 1 to the first, rest position shown in FIG. 2, the pin 42 slides along the locking member 31 until the head of the pin 42 engages in the blind bore 41 of the locking member 31. The release of the hand operated opening lever 1 from its first, rest position shown in FIG. 2 is obtained by operation in a reverse order of the foregoing steps relating to fastening of the locking member 31 to the fastening device 21, that is, the head of the pin 42 must be initially pressed out of the blind bore 41 and then slid relative to the slot 40 until the enlarged head of the pin 42 reaches the circular opening 39. It is therefore necessary to initially press the pin 42 downwardly (toward the lever body 8) to remove the head of the pin 42 from the blind bore 41 so that the locking member 31 can be moved relative to the pin 42 of the fastening device 21.

FIG. 5 shows that, on both sides of the toothed wheel 16, the transfer apparatus 7 includes a bearing bush 32 mounted in a projection 43 of the lever body 8 and another bearing bush 33 mounted in a cover member 34. The cover member 34 is releasably fastened to the lever body 8 by a plurality of screws 44. The toothed wheel 16 (which is constructed of a plurality of segments) and the projection 19 (shown in FIG. 3) project radially from an axis of rotation of the transfer apparatus 7, beyond the outer diameter of the bushings 32 and 33. When the toothed wheel 16 and the projection 19 are pivoted about the axis of the transfer apparatus 7 in the circumferential direction 46, they are able to move within a hollow cavity formed between the inner wall of the cover 34 and a recess 45 in the lever body 8. The transfer apparatus 7 (which is composed of bushings 32 and 33, the toothed wheel 16, the projection 19, the recess 13 and the follower surface 20) has a length along its axis of rotation which is generally equal in magnitude to the width of the lever body 8. Due to the splined connection 37 provided between the transfer apparatus 7 and a stump 47 of the opener shaft 4, the transfer apparatus 7 and the lever body 8 can be easily pushed together, from a location which is outside of the lever body 8, onto the stump 47. The transfer apparatus 7 and the lever body 8 are axially secured by a further screw 48. This screw is secured against loosening by a spring safety member 49 which is disposed within the housing stump 47 of the opener shaft 4.

The opener shaft 4 is supported in a known manner within the base member 5 by an axial bearing 50 and a radial bearing 51. The axial bearing 50 and the projection 43 of the lever body 8 are disposed within a bore 55 in the base member 5.

For manual opening of the breechblock 2 by means of the hand-operated opening lever 1 when the opening lever 1 is in the first, rest position, the pin 42 fastened to the base member 5 must be depressed in the manner described hereinabove to release the connection with the locking member 31 disposed adjacent the hand-operated opening lever 1. If the hand-operated opening lever 1 is pivoted in a first rotational direction 53, the radial face 20 of the projection 19 is carried along by an oppositely disposed face 52 of the lever body 8. The transfer apparatus 7 is thereby caused to rotate with the opening lever 1. The rotation of the transfer apparatus 7 causes rotation of the opener shaft 4, thereby causing the opening levers 36 and 36' to be moved until they open the wedge-type breechblock 2. When the opening lever 1 is moved in the first direction 53 during the pivoting process, the toothed wheel 16 is caused to move as a unit together with the toothed rod 12 and the lever body 8, thereby preventing movement of the toothed rod 12 toward the right in FIG. 3, and therefore the gas compression spring 6 is not compressed during movement of the hand-operated opening lever 1. The projection !9 of the transfer apparatus 7 is thereby rotated by the opening lever 1 from a position A (shown in solid outline in FIG. 3) to a position B (shown in phantom outline in FIG. 3) in which the opening lever 1 remains while the wedge-type breechblock 2 is in the open position. The wedge-type breechblock 2, which is in this instance manually driven to its open position by the rotation of the opener shaft 4 caused by the movement of the opening lever 1, is then held in the open position by a locking device or bolt (not shown). When the hand-operated opening lever 1 is pivoted in a second direction 54, and with the locking pin 14 in its non-engaged or rest position (i.e., without manual pressure on the end 38) and with the breechblock 2 locked in its open position, the toothed wheel 16 remains stationary and does not rotate with either the opening lever 1 or the lever body 8. The toothed wheel 16 under these circumstances is locked in position relative to the opener shaft 4 due to the locking of the wedge-type breechblock in the open position by the locking device (not shown) mentioned above, since the toothed wheel 16 is fixed for rotation with the opener shaft 4. Therefore, under these circumstances, upon subsequent motion of the opening lever 1 toward the first, rest position shown in FIG. 2, the toothed rod 12 is thereby caused to travel relative to the toothed wheel 16. Therefore, under the aforementioned circumstances, this engagement of the toothed wheel 16 with the toothed rod 12 causes the gas compression spring 6 to perform the compression stroke s during the return stroke of the opening lever 1 to its first, rest position.

During automatic operation, the opening lever 1 is in its first, rest position shown in FIG. 2. In this position, the rotation of the toothed wheel 16 with the opener shaft 4 causes corresponding travel of the toothed rod 12. The gas compression spring 6 is compressed during clockwise rotation (as viewed in FIG. 3) of the toothed wheel 16, and relaxes the gas compression spring 6 during counterclockwise rotation (as viewed in FIG. 3) of the toothed wheel 16. The closing stroke (i.e., during rotation of the opener shaft 4 and toothed wheel 16 in the direction indicated at 54 in FIG. 3) for the wedge-type breechblock 2 is, under these circumstances, generated by the force of the gas compression spring 6 whose force, due to its relatively flat characteristic force response curve, remains approximately constant. Under these circumstances, the gas compression spring 6 thereby causes pivoting movement of the transfer apparatus 7 back from the position indicated at B to the position indicated at A.

The wedge-type breechblock 2 is opened automatically during advancement of the gun barrel of the gun 3. While the hand-operated opening lever 1 then remains locked in its rest position at the base member 5, a starting lever (not shown) rotates the opener shaft 4 and, due to transfer of the rotary movement to the opening levers 36 and 36' engaging the wedge-type breechblock 2, the wedge-type breechblock 2 is opened. Due to the fact that the opener shaft 4 can rotate relative to the transfer apparatus 7 during movement of the transfer apparatus 7 from the starting position indicated at A to the end position indicated at B, the gas compression spring 6 is compressed during the longitudinal movement toward the right in FIG. 3 of the toothed rod 12 and the piston 9.

If the wedge-type breechblock 2 is difficult to close or jams during automatic operation, the closing process can nevertheless be performed completely by an additional manual operation. To accomplish this, the hand-operated opening lever 1 is pivoted from its rest position secured to the base member 5 to cause movement of the transfer apparatus 7 from the position indicated at A to the position indicated at B. Then, by thumb pressure on the end 38 of the locking bolt 14 when the transfer apparatus 7 is in the position indicated at B, the distal end 61 of the locking bolt 14 engages in the recess 13 adjacent the projection 19. This causes engagement of the distal end 61 of the locking pin 14 with the recess 13 to establish a connection between the locking pin 14 and the transfer apparatus 7 so that the wedge-type breechblock 2 can be closed by manual rotation of the opening lever 1 in the direction indicated by the arrow 54 to consequently cause rotation of the opener shaft 4, which in turn causes movement of the opening levers 36 and 36'. During this manual closing movement, the transfer apparatus 7, the toothed rod 12 and the gas compression spring 6 constitute a unit which moves with the lever body 8 so that no additional forces are generated by the gas compression spring 6.

It will be understood that the above description of the present invention is susceptible to various modifications, changes and adaptations, and the same are intended to be comprehended within the meaning and range of equivalents of the appended claims.

What is claimed is:

1. A hand-operated opening lever in a gun which is pivotal about an opener shaft for actuating the opener shaft to move a wedge-type breechblock between an open position and a closed position, comprising:

a lever body pivotally connected to a support for movement relative to said opener shaft, said lever body being movable between a first, rest position and a second position for respective manual opening and closing operations; said lever body including a manually displaceable locking bolt and an energy storing means which includes a receiving chamber;

transfer means in form-locking connection with said opener shaft for transferring stored energy between said opener shaft and said lever body for actuating said opener shaft to move the wedge-type breechblock between the open position and the closed position; said transfer means, causing energy to be stored in said energy storing means in said lever body, and transferring stored energy from said energy storing means to said breechblock; said transfer means including engaging means which are selectively engageable with said lever body during the manual opening and closing operations; said engaging means including a form-locking connection with said lever body during the manual opening operation of said wedge-type breechblock, and, during the manual closing process, including a form-locking connection with said manually displaceable locking bolt mounted in said lever body housing;

said energy storing means comprising a gas pressure spring having a piston and a toothed rod connected to said piston, said gas pressure spring being disposed in said receiving chamber within said lever body; said toothed rod being in engagement with said transfer means; said energy storing means, in said first, rest position of said lever body, being compressed by said transfer means and, during a movement of the breechblock to the closed position, said energy storing means drives said toothed rod to cause said breechblock to move to said closed position; said energy storing means being inactivated during manual opening and closing of said wedge-type breechblock by said lever body when the breechblock is unlocked and the locking bolt has been forwardly activated.

2. An hand-operated opening lever as claimed in claim 1, wherein said transfer means includes a transfer means axis and an exterior portion which is shaped, over an angular range $\alpha$ about said transfer means axis, as a toothed wheel; said exterior portion shaped as a toothed wheel being in toothed engagement with said toothed rod; said exterior portion shaped as a toothed wheel having a circumference along said angular range $\alpha$ which is longer than the compression path of said piston of said gas pressure spring.

3. A hand-operated opening lever as defined in claim 2, wherein said engaging means includes a radially oriented projection disposed at said transfer means outside said angular range $\alpha$ of said toothed wheel, said projection including a radial face which, during the manual opening operation, is carried along by said lever body; and said projection including a recess for engaging said locking bolt during the manual closing operation.

4. A hand-operated opening lever as defined in claim 1, wherein said lever body includes a centering means for centering said piston of said gas pressure spring throughout the stroke of said piston.

5. A hand-operated opening lever as defined in claim 1, wherein said toothed rod, said piston, and said receiving chamber are disposed in a linear arrangement in said lever body.

6. A hand-operated opening lever as defined in claim 1, wherein said lever body further comprises a threaded insert member for sealing gas in said receiving chamber, said threaded insert member being accessible from outside said lever body.

7. A hand-operated opening lever as defined in claim 1, wherein said locking bolt has a guide which projects into an outer region of said lever body, said guide having a stop portion for limiting travel of said locking bolt out of said guide, said stop portion including a threaded member which is in threaded engagement with a portion of said lever body supporting said guide.

8. A hand-operated opening lever as defined in claim 3, wherein said lever body includes a housing bore which receives said locking bolt, said housing bore having a widened portion for receiving a return spring; and said locking bolt having a projection which is in engagement with said return spring for return of said locking bolt from a locked position to an unlocked position relative to said recess in said transfer means.

9. A hand-operated opening lever as defined in claim 1, wherein said lever body includes a locking member connected to the exterior of said guide for engagement with a fastening means disposed on said support.

10. A hand-operated opening lever as defined in claim 2, wherein said transfer means includes bearing bushes which are respectively disposed on both sides of said toothed wheel in a direction along said transfer means axis, one of said bearing bushes being supported in a portion of said lever body and the other one of said bearing bushes being supported in a cover which is releasably fastened to said lever body.

* * * * *